United States Patent [19]

King et al.

[11] Patent Number: 4,927,176

[45] Date of Patent: May 22, 1990

[54] SKI-MOUNTABLE DEVICE FOR SCRAPING BOOTS

[75] Inventors: Allen B. King; Thomas J. Perfetti, both of Vail, Colo.

[73] Assignee: Exci-Tech Industries, Inc., Vail, Colo.

[21] Appl. No.: 275,403

[22] Filed: Nov. 23, 1988

[51] Int. Cl.[5] ..... A63L 11/18

[52] U.S. Cl. ..... 280/813

[58] Field of Search ..... 280/813, 809, 816

[56] References Cited

U.S. PATENT DOCUMENTS

| | | | |
|---|---|---|---|
| D. 213,906 | 4/1969 | Moore | D21/99 |
| D. 247,415 | 3/1978 | Harper | D7/5 |
| 3,284,091 | 11/1966 | Spier | 280/11.13 |
| 3,826,518 | 7/1974 | Hennig | 280/11.13 |
| 3,976,303 | 8/1976 | Lillibridge | 280/11.37 |
| 3,976,304 | 8/1976 | Lillibridge | 280/11.37 |
| 3,999,773 | 12/1976 | Shuttleworth | 280/11.37 |

FOREIGN PATENT DOCUMENTS

| | | | |
|---|---|---|---|
| 2450096 | 4/1976 | Fed. Rep. of Germany . | |
| 2517491 | 4/1976 | Fed. Rep. of Germany | 280/813 |
| 2514632 | 10/1976 | Fed. Rep. of Germany . | |
| 2607760 | 9/1977 | Fed. Rep. of Germany . | |
| 2648415 | 3/1979 | Fed. Rep. of Germany . | |
| 2247264 | 5/1975 | France . | |
| 637841 | 8/1983 | Switzerland . | |

*Primary Examiner*—Charles A. Marmor
*Assistant Examiner*—Richard Camby
*Attorney, Agent, or Firm*—Dorr, Carson, Sloan & Peterson

[57] ABSTRACT

The present invention is a device for removing debris from the soles of ski boots prior to locking the ski boots in the bindings of skis. The device is a compact, low profile scraper mountable on the skis themselves. The scraper is formed of a molded plastic material having flexible properties at extremely cold temperatures. The scraper has slanting side surfaces with a single semi-cylindrical channel formed in the scraper body extending the full length of the scraper. The upper surface of the scraper has two narrow flat lip surfaces. The lip surfaces and the slanting side surfaces form blunt scraping edges. The single relatively large channel provides an efficient method of removing debris and also allowing the scraper body to flex about its longitudinal axis. The scraper is mounted on the ski so that channel is parallel to the longitudinal axis of the ski. The ability of the ski to flex about its longitudinal axis is not limited by the addition of the scraper. Thus, the performance of the ski is not affected.

1 Claim, 3 Drawing Sheets

Fig. 5
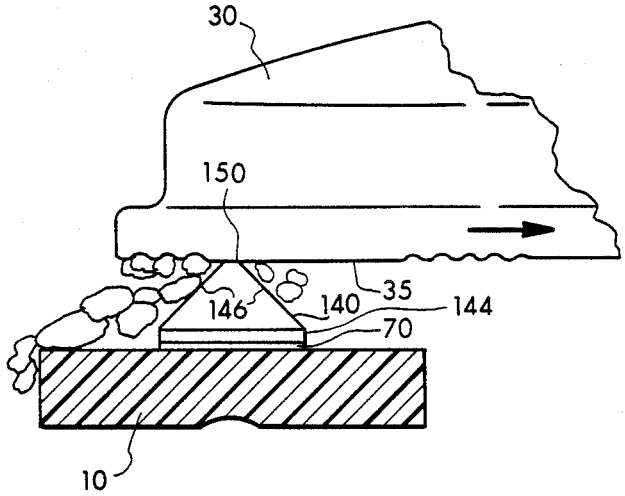
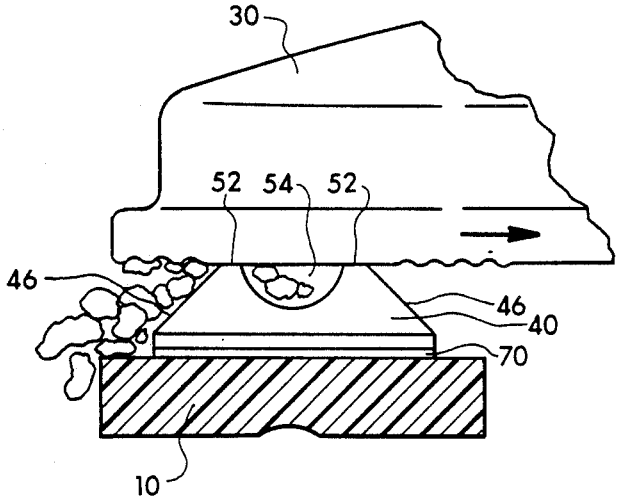
Fig. 6

SKI-MOUNTABLE DEVICE FOR SCRAPING BOOTS

BACKGROUND OF THE INVENTION

1. Field of the Invention

This invention relates to a device for scraping snow, ice and other debris from the sole of a ski boot before the boot is inserted into the binding of a ski.

2. Statement of the Problem

In order for a skier's boot to properly lock into the ski binding, the sole of the boot must be clean of any snow, ice or debris. If the boot sole is not clean, then either the boot will not properly lock in the binding or the boot will become snow-locked in the ski binding. Should the boot become snow-locked, it may not release upon the skier falling thus resulting in injury to the skier.

The most common way of cleaning off ski boot soles is by manually scraping with a ski pole or by hand. This method is awkward and inconvenient, particularly when the skis have come off on a downhill slope.

Other ways include portable boot scrapers and ski-mounted scrapers. Portable scrapers require the carrying around of the scraper and are cumbersome and awkward to use. The current invention is concerned with the latter method of mounting a scraper directly onto the skis. There have been several attempts in the past to mount such devices directly onto the skis.

For instance, U.S. Pat. No. 3,284,091 discloses a ski-boot scraper mounted on a ski wherein the scraper is a rigid flat molded plastic bar with an upstanding axially elongated flange which is resistant to flexing. The scraper is mounted angularly relative to the longitudinal axis of the ski.

U.S. Pat. No. 3,826,518 discloses a ski-boot scraper mounted on a ski wherein the scraper is an elongated member having a series of spaced V-shaped sections upwardly projecting from the member to scrape the boot on. The scraper also comprises an upwardly extending crown piece to assist in controlling the ski during the scraping operation.

U.S. Pat. Nos. 3,976,303 and 3,976,304 disclose a ski-boot scraper mounted onto a ski wherein the scraper is a upwardly extending device having a smaller base than the upper part of the scraper.

U.S. Pat. No. 3,999,773 discloses a ski-boot scraper comprising an upwardly extending rigid flange diagonally mounted on the ski.

U.S. design patent 213,906 discloses an ornamental design for a snow scraper wherein the scraper is apparently a rectangular box-shaped structure with diagonal grooves on its upper surface.

U.S. design patent 247,415 discloses an ornamental design for a snow scraper comprising a plurality of upstanding triangular edges.

French document 2,247,264 discloses an ski-boot scraper comprising an inverted T-shape with a toothed web in its upper surface.

The German Offenlegungsschrift 25 14 632 discloses a boot scraper comprising a device with slanted sides having either a grid surface or a plurality of elongated channels fixed longitudinally on the ski. The scraper can either be mounted by screws or by an adhesive pad.

The German offenlegungsschrift 24 50 096 discloses a ski-boot scraper comprising a plate having a number of serrations mounted on a ski so that the serrations are diagonal to the longitudinal axis of the ski.

The German Offenlegungsschrift 26 07 760 discloses a ski-boot scraper comprising a circular body having a number of upstanding scraping edges attached to the ski either by screws or adhesive.

The German Offenlegungsschrift 26 48 415 discloses a snow scraper comprising a triangular rail mounted onto the ski.

The Swiss Patentschrift 637,841 discloses a snow scraper comprising an upstanding edge mounted at an angle to the ski.

There are several problems associated with the prior attempts at mounting a ski-boot scraper onto a ski. A ski must be able to freely flex about the axes generally parallel to its longitudinal axis in order to perform as designed. The known mounted ski-boot scrapers reduce the capacity of the ski to flex thus reducing the performance and safety aspects of the ski.

Another problem associated with the prior ski-boot scrapers is the relatively high profile and sharp edges of the scrapers. This creates an injurious situation to the skier should a skier fall occur. Also, the skis have a tendency to lock together on the scrapers when the skis cross each other.

The prior ski-boot scrapers were generally made from materials which becomes hard and brittle in the cold temperatures encountered during winter skiing. This creates even more stiffness in the flexibility of the ski as well as adding to the possibility of skier injury should the skier fall on the scraper.

The scrapers of the prior art devices fail to provide adequate channeling of the debris removed from the boot sole. The scraper channels of the prior art tend to become snow packed. This limits the ability of the scrapers to effectively clean the boot sole.

None of the prior devices provide a low-profile flexible ski-boot scraper that will adequately clean ski-boot soles without hindering the performance and safety features of the ski.

Therefore a need exists for a ski-boot scraper mountable on a ski that will enable the skier to clean the bottom of the skier's boot and will not reduce the safety and performance of the ski.

3. Solution to the Problem

The current invention solves these and other problems by providing a ski-mounted ski-boot scraper that is flexible and does not have any sharp edges or corners.

The scraper of the current invention is designed not to interfere with the capacity of the ski to flex or to hinder the performance of the ski.

The scraper of the current invention is a compact low-profile design to reduce the risk of injury to the skier.

The ski-boot scraper of the current invention is formed of a flexible soft material that is capable of enduring extremely low temperatures without becoming hard and brittle.

SUMMARY OF THE INVENTION

The current invention is a ski-boot scraper that is mountable on to a ski so that it is always available to the skier as needed.

The scraper is formed of a firm, somewhat flexible molded plastic material such as A.B.S. high impact plastic Monsanto 648 Lustran, which will retain its properties to temperatures down to 60 degrees below zero. This material will allow the scraper, when mounted on to the ski, to flex as the ski flexes. Prior art devices were rigid and inflexible and would retard the performance of the ski. The current invention utilizes the properties of the molded plastic body as well as the design of the scraper to allow the skier to fully utilize the performance of the ski as the ski was designed.

The scraper body is designed to be low-profile with a blunt striking area to reduce not only the drag on the ski but the chance of injury to the skier. The body is formed having a rectangular shaped bottom surface. The outer sides which include two longitudinal side surfaces and the two end surfaces are inwardly directed from the bottom surface to the top surface. The top surface is a flat surface having a smaller cross-sectional area than the bottom surface. The inwardly directed longitudinal side surfaces and the top surface form scraping surfaces that the sole of a ski boot can be scraped against to remove snow and debris from the sole of the ski boot.

A semi-cylindrical channel extending the length of the body is formed opening into the top surface. The channel performs two purposes. First, it channels the debris from the sole of the boot away from the scraping surfaces. Secondly, it reduces the amount of the material in the center of the scraper body. This allows the scraper body to more freely flex about its longitudinal axis.

The scraper is typically mounted onto the ski several inches behind the rear ski binding. The scraper is mounted so that the longitudinal axis of the scraper body is parallel to the longitudinal axis of the ski. This allows the scraper to flex about its longitudinal axis as the ski flexes about its longitudinal axis. Thus, the ability of the ski to perform is not reduced by the mounting of the scraper body on the ski.

The scraper body is mounted to the ski either by a high strength double sided adhesive tape, such as Arlone No. 101 tape, or by two small mounting screws. The use of the adhesive tape allows the ski to flex in the area behind the binding as if the scraper was not present.

The scraper is available in different colors to compliment the designs of most of the popular ski models.

In use, the scraper body is easily mounted on the ski as discussed above by either the skier or by the ski manufacturer. The skier can then, before attempting to lock the skier's boots into the ski binding simply scrape the bottom sole of the boot against the scraping surfaces of the scraper in either direction. Once the boots have been cleaned, they will more easily lock into the ski bindings.

These and other features will become obvious from the following description in conjunction with the drawings.

The claimed invention is not meant to be limited by the descriptions of the invention but encompasses other modifications and variations within the scope of the invention.

BRIEF DESCRIPTION OF THE DRAWINGS

FIG. 5 shows a perspective view of a second embodiment having only one scraping surface; and FIG. 6 shows a cross-sectional view of a boot being scraped on a scraper mounted to the ski by adhesive bonding.

DETAILED DESCRIPTION OF THE INVENTION

Figure 1:
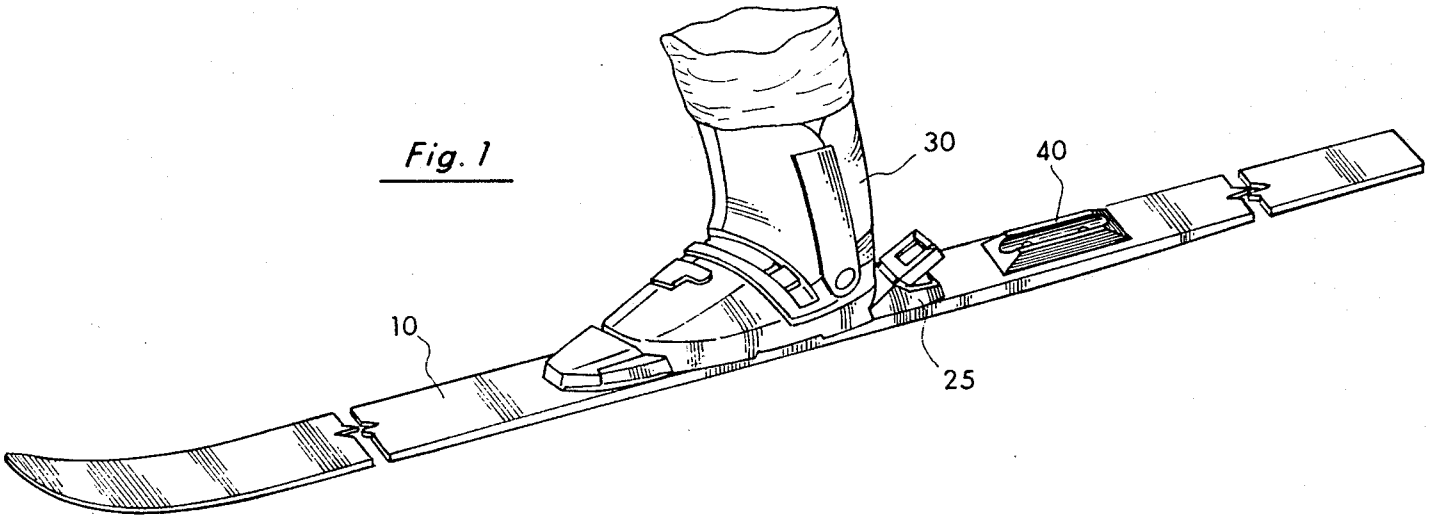
FIG. 1 shows a perspective view of the scraper of the current invention mounted on a snow ski.
Figure 2:
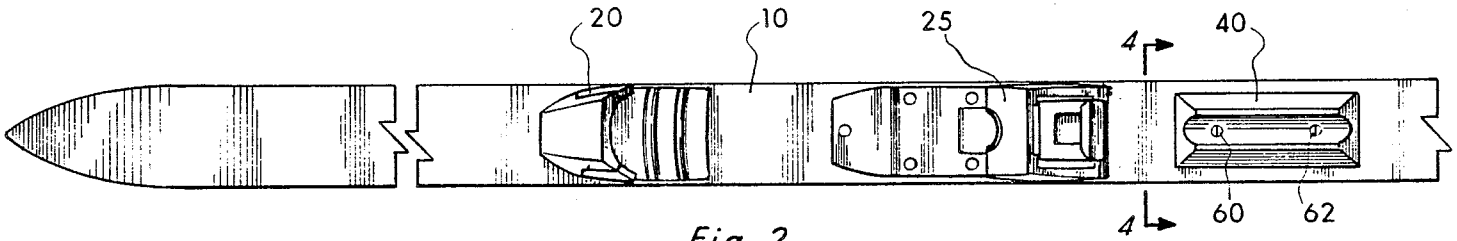
FIG. 2 shows a top view of the scraper of the current invention mounted a snow ski.

The preferred embodiment of the current invention is illustrated in FIGS. 1 and 2. The ski-boot scraper 40 of the current invention is shown mounted onto an alpine downhill ski 10 behind the rear binding 25 of the ski. The invention is not meant to be limited solely to this application but is designed to be used with all manner of skis and the like; for instance nordic cross-country skis and back-country skis.

Figure 3:
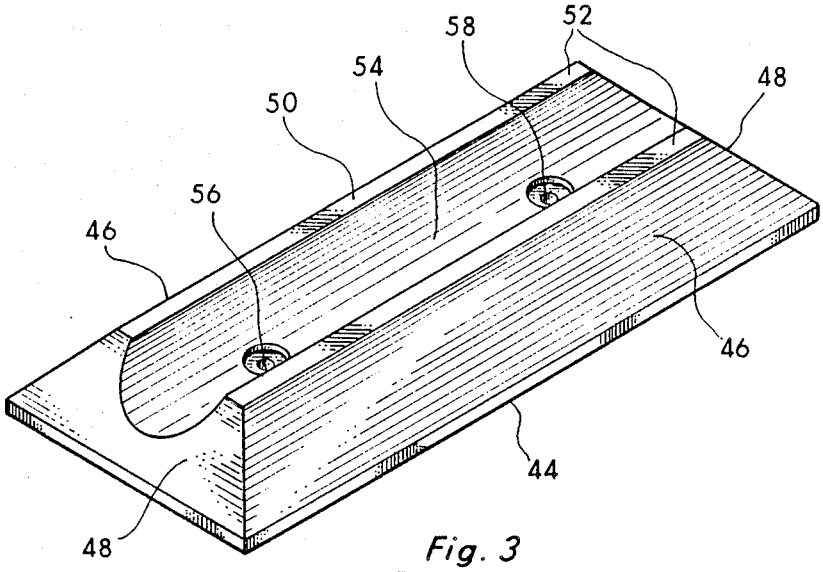
FIG. 3 shows a perspective view of the scraper alone.

The scraper 40 is formed of a molded plastic material, such as A.B.S. high impact plastic Monsanto 648 Lustran. This material exhibits the properties of being firm yet flexible even at extremely cold temperatures, e.g. sixty degrees below zero, without becoming hard and brittle. As shown in FIG. 3, the scraper 40 includes an elongated body having a flat rectangular bottom surface 44. The outer surfaces of the scraper body consist of two elongated longitudinal side surfaces 46, two end surfaces 48 and an upper surface 50. The longitudinal side surfaces 46 and the end surfaces 48 extend from the bottom surface 44 upwardly in an inwardly directed manner to the upper surface 50.

The upper surface 50 is a flat rectangular surface having a smaller surface area than the bottom surface 44. A substantially semi-cylindrical channel 54 is formed in the upper surface 50 parallel to the longitudinal axis of the scraper body . The channel 54 extends to a depth of approximately half the thickness of the scraper body and extends the full length of the scraper. The channel 54 opens upward in the upper surface 50 of the scraper body thus forming two parallel narrow lips 52 on either side of the channel 54 on the upper surface 50.

Figure 4:
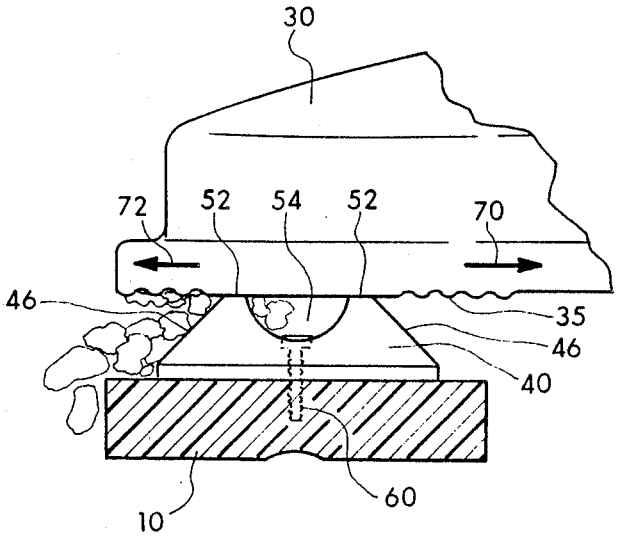
FIG. 4 shows a partial side view of FIG. 2 along line 4—4 showing a ski boot sole being scraped against the scraper.

Mounting holes 56 and 58 are formed in the bottom of the semi-cylindrical channel as shown in FIG. 3. The scraper body is mounted to the ski by either two small screws 60 as shown in FIG. 4 or by an adhesive bonding 70 as shown in FIG. 6. One preferred adhesive bonding is a double sided high strength adhesive tape such as 1/16" thick Arlone No. 101.

The scraper body is mounted on the ski slightly behind the rear ski binding as illustrated in FIGS. 1 and 2. The scraper may also be mounted anywhere along the upper surface of the ski, but the rear mounting is preferred for several reasons. First, to reduce the possibility of the knee of the skier from banging against the scraper, second, to prevent the tips of the skis from locking on the scraper bodies should the tips of the skis cross and third, to reduce the aerodynamic drag on the ski.

As shown in FIGS. 1 and 2, the scraper body is mounted in the center of the ski 10 so that the semi-cylindrical channel 54 is parallel to the longitudinal axis of the ski. The formation of the channel 54 reduces the amount of material in the scraper body, particularly about the central longitudinal axis of the scraper body. This has the effect of increasing the flexibility of the scraper body about its longitudinal axis. Since the central longitudinal axis of the scraper body is parallel to the central longitudinal axis of the ski, there is limited impairment of the ability of the ski 10 to flex about its longitudinal axis. One of the critical elements in the performance of the ski is its ability to flex about its longitudinal axis. Thus, unlike prior scrapers, the scraper of the current invention will not impair the performance of the ski on which the scraper is mounted.

The inwardly directed longitudinal sides 46 and the narrow lips 52 on the upper surface 50 form the scraping surfaces on the scraper body. As shown in FIGS. 4 and 6, the sole 35 of the ski boot 30 is scraped against the upper surface 50 of the scraper body mounted on the ski 10. The boot 30 can be scraped in either direction as shown by arrows 70 and 72. The lips 52 and the edges formed by the upper surface 50 and the side surfaces 46 provide the scraper action effect against the boot soles. The debris from the bottom of the boot sole 35 is directed either down the slanting sides 46 or down into the channel 54 where it is forced out the end surfaces 48. The scraper thus provides three paths for removal of the debris from the boot sole; the two sides 46 and the channel 54. The use of the two sides allow the boots to be more efficiently cleaned by a double action effect. Should the boot sole 35 not be entirely cleaned by the action of the first scraping edge it contacts, then the second scraping edge will complete the cleaning process.

The use of a single relatively large semi-cylindrical channel 54 instead of a series of small grooves as in the prior devices, enables the debris to be more efficiently channeled out of the scraper body. Prior devices using a plurality of small grooves tend to pack with the debris and become ineffective. The single large channel 54 of the present invention allows the debris to move out of the scraper more easily. The single channel also is more easily cleaned than the multiple grooves of the prior art.

The two lips 52 on the upper surface 50 provide effective scraping action without the danger of having a single rail-type scraper. The rail-type scrapers create a danger of the skier banging the skier's knee or some other part of the skier's body on the rail. The tips of the skis have a tendency to lock on the rails as well. In the current invention, the use of the two lips having a blunt surface on the relatively compact, low profile scraper body reduce the chance of injury to the skier as well as reducing the drag on the aerodynamics of the skier and the tendency of the ski tips locking on the scraper.

A second embodiment of the current invention is shown in FIG. 5. The second embodiment 140 uses two longitudinal side surfaces 146 inwardly directed from the bottom surface 144 of the scraper body 140. The upper surface 150 is a thin rectangular lip forming the scraper edge with the side surfaces 146. The scraper body is mounted in a similar fashion as the first embodiment so that the longitudinal axis of the scraper body is parallel to the longitudinal axis of the ski 10. The scraper body is mounted either by the adhesive bonding 70 discussed above or else by small mounting screws 60.

The second embodiment is also a low profile, compact structure having a blunt striking surface so the risk of injury is reduced as well as the aerodynamic drag and tendency of the ski tips to lock together on the scraper.

The scraper is provided in a plurality of different colors that will compliment most of the current models of popular skis. The compact, low profile of the scraper body will not detract from the aesthetics of the skis. The design and choice of material create a relatively inexpensive accessory for skis which can either be provided on the ski by the ski manufacturer or else easily added on by the skier.

The scraper of the current invention provides an inexpensive device for efficiently cleaning the soles of ski boots before locking the boots in the ski bindings. The scraper of the current invention provides a safer and more efficient device than the prior scraper devices for several reasons, enumerated below, but not meant to be limited thereto.

First, the lower profile and blunt scraping edges reduce the chance of a skier being injured should a portion of the skier's body strike the scraper. Second, the lower profile reduces the aerodynamic drag on the ski itself. Third, the lower profile and blunt edges reduce the tendency of the skis to lock should the skis cross. Fourth, the double sides of the preferred embodiment create a more efficient method of cleaning the boot soles. Fifth, the single relatively large channel increases the efficiency of the removal of the debris from the boot sole as well as from the scraper body. Sixth, the design of the channel increases the flexibility of the scraper thus allowing the ski to perform as designed. Seventh, the design of the scraper does not detract from the aesthetics of the ski itself. For these and other reasons implicit in the design and use of the current invention, the scraper of the current invention is an advancement in cleaning the soles of ski boots.

It is to be expressly understood that the claimed invention is not to be limited to the description of the preferred embodiments but encompasses other modifications and alterations within the scope and spirit of the inventive concept.

We claim:

1. A boot scraper for use on a snow ski, said scraper comprising:

an elongated, rectangularly shaped body;

means for removably mounting said elongated body on said snow ski so the integrity of the inner core of said snow ski is not harmed and said elongated body can be removed from said snow ski without harm to the finish of said snow ski; said mounting means comprising double-backed high tensile strength adhesive tape corresponding to said rectangular shape of said elongated body;

means formed in the upper surface of said elongated body for scraping debris from the sole of a boot; said scraping means comprising outer side surfaces formed on the opposing and longer edges of said elongated body, said formed outer edges extending upwardly and inwardly toward each other from the bottom surface of said elongated body, each of said formed outer edges terminating in narrow rectangular lip surfaces formed on the upper surface of said elongated body, said narrow rectangular lip surfaces being parallel to each other and to the bottom of said elongated body and functioning to remove said debris from said sole as said sole is scraped across both said narrow rectangular lip surfaces, each of said narrow rectangular lip surfaces being located a predetermined distance from said bottom surface of said elongated body;

means for directing said scraped debris from said sole, said directing means comprising a longitudinal channel having a circular shaped arc cross-section, the radius of said circular shaped arc being substantially less than said predetermined distance;

means to allow said elongated boy to substantially flex about the longitudinal axis of said snow ski at temperatures below zero degrees as said snow ski flexes so there is limited impairment of the performance of said snow ski, said flexing means comprising forming said body of a material having the properties of resilience and flexibility at temperatures below zero degrees; said flexing means further comprising forming said channel to extend substantially half of the thickness of said body and mounting said body so said channel extends along the central longitudinal axis of the rectangularly shaped portion of said snow ski; and means formed on opposing ends of said elongated body for deflecting crossed ski tails; said deflecting means comprise forming said opposing ends of said elongated body in a low-profile shape with inwardly sloping corners and parallel scraping edges.

* * * * *